US008297540B1

(12) United States Patent
Vijay

(10) Patent No.: US 8,297,540 B1
(45) Date of Patent: Oct. 30, 2012

(54) REVERSE-FLOW NOZZLE FOR GENERATING CAVITATING OR PULSED JETS

(75) Inventor: Mohan M. Vijay, Gloucester (CA)

(73) Assignee: VLN Advanced Technologies Inc., Ontario (CA)

( * ) Notice: Subject to any disclaimer, the term of this patent is extended or adjusted under 35 U.S.C. 154(b) by 0 days.

(21) Appl. No.: 13/206,786

(22) Filed: Aug. 10, 2011

(30) Foreign Application Priority Data

May 31, 2011 (CA) ..... 2742060

(51) Int. Cl.
*B05B 1/08* (2006.01)
*B05B 1/00* (2006.01)

(52) U.S. Cl. ..... 239/589; 239/589.1

(58) Field of Classification Search ..... 239/101, 239/142, 427–429, 432, 433, 543, 589, 589.1, 239/DIG. 7; 137/825, 826; 366/131, 136, 366/137, 341
See application file for complete search history.

(56) References Cited

U.S. PATENT DOCUMENTS

| | | | | |
|---|---|---|---|---|
| 2,949,900 | A | 8/1960 | Bodine | |
| 3,729,871 | A | 5/1973 | Taylor | |
| 4,463,904 | A * | 8/1984 | Bray, Jr. | 239/589.1 |
| 4,666,083 | A | 5/1987 | Yie | |
| 5,125,582 | A * | 6/1992 | Surjaatmadja et al. | 239/589 |
| 5,217,163 | A * | 6/1993 | Henshaw | 239/101 |
| 5,643,058 | A | 7/1997 | Erichsen et al. | |
| 5,752,829 | A | 5/1998 | Goldsmith et al. | |
| 5,927,306 | A | 7/1999 | Izumi et al. | |
| 6,000,308 | A | 12/1999 | LaFountain et al. | |
| 6,240,945 | B1 * | 6/2001 | Srinath et al. | 137/14 |
| 6,444,259 | B1 | 9/2002 | Subramanian et al. | |
| 6,976,507 | B1 * | 12/2005 | Webb et al. | 137/826 |
| 7,108,585 | B1 | 9/2006 | Dorfman et al. | |
| 7,594,614 | B2 | 9/2009 | Vijay et al. | |
| 7,830,070 | B2 | 11/2010 | Babaev | |

(Continued)

FOREIGN PATENT DOCUMENTS

| | | |
|---|---|---|
| DE | 10158622 | 6/2003 |

(Continued)

OTHER PUBLICATIONS

Vijay, Mohan V., "Design and development of a prototype pulsed waterjet machine for the removal of hard coatings", BHR Group Conference Series—14th International Conference on Jetting Technology, 21-23, pp. 39-57, Sep. 1998.

*Primary Examiner* — Darren W Gorman
(74) *Attorney, Agent, or Firm* — Gardner, Linn, Burkhart & Flory, LLP

(57) ABSTRACT

A reverse-flow nozzle generates a cavitating and/or pulsed jet of pressurized liquid. The nozzle includes a body having an inlet for receiving a stream of liquid and a main channel through the body extending from the inlet to an outlet. A flow-reversing channel in the nozzle diverts a portion of the liquid from the main channel to a point downstream of a mixing chamber. The channel returns the diverted liquid back into the mixing chamber as a reverse-flow jet relative to a main stream of liquid flowing toward the outlet. This reverse-flow jet interacts with the main stream to generate the cavitating jet that discharges from the outlet. By angling the reverse-flow jet relative to the main stream, a naturally pulsed jet may be generated.

30 Claims, 4 Drawing Sheets

U.S. PATENT DOCUMENTS

| | | | |
|---|---|---|---|
| 2002/0066770 | A1 | 6/2002 | James et al. |
| 2002/0098776 | A1 | 7/2002 | Dopper |
| 2007/0098912 | A1 | 5/2007 | Raybould et al. |
| 2008/0160332 | A1 | 7/2008 | Dighe et al. |
| 2009/0224066 | A1 | 9/2009 | Riemer |
| 2010/0015892 | A1 | 1/2010 | Vijay et al. |
| 2010/0124872 | A1 | 5/2010 | Hashish et al. |
| 2011/0011952 | A1 | 1/2011 | Brusa |
| 2011/0247554 | A1 | 10/2011 | Vijay |
| 2011/0250361 | A1 | 10/2011 | Vijay |

FOREIGN PATENT DOCUMENTS

| | | |
|---|---|---|
| DE | 102005061401 | 6/2007 |
| EP | 0647505 | 2/2000 |
| EP | 1016735 | 7/2000 |
| EP | 0703040 | 10/2000 |
| EP | 1160339 | 12/2001 |
| EP | 2145689 | 1/2010 |
| GB | 2335202 | 1/2003 |
| JP | 58052467 | 3/1983 |
| JP | 59070757 | 4/1984 |
| JP | 61037955 | 2/1986 |
| WO | 9213679 | 8/1992 |
| WO | 9814638 | 4/1998 |
| WO | 2005042177 | 5/2005 |

* cited by examiner

REVERSE-FLOW NOZZLE FOR GENERATING CAVITATING OR PULSED JETS

TECHNICAL FIELD

The present invention relates generally to nozzles and, in particular, to nozzles for generating cavitating or pulsed jet.

BACKGROUND

Cavitating jet generating devices have been known and documented in the technical literature. A number of patents have also issued pertaining to various cavitating jet systems, U.S. Pat. Nos. 5,217,163; 5,154,347; 5,125,582; and 5,086,974 are examples of technologies already known in the art. Cavitation has been known as a deleterious factor, for example, in the marine industry where it may severely damage propellers and other underwater components of ships. When cavitation bubbles collapse on a surface, the collapsing bubbles produce very high-speed micro jets which are responsible for the damage to the surface by erosion. The same erosive power of cavitation is beneficial when used in certain applications, for example fragmenting ore-bearing hard rocks in the mining industry or removing solid particles from a substrate, to name but a few possible applications.

Known cavitating waterjet systems only produce effective high-speed cavitating jets when submerged. When a high-speed continuous waterjet is fully submerged in quiescent water, shear layers develop in the mixing zone of the jet and the still water. These shear layers produce vortices which give rise to cavitation bubbles (containing water vapor, not air) in the high-speed waterjet. Prior-art cavitating jets in air usually experience a loss of cavitating power due to a partial collapse of the vapor bubbles present in the cavitating jet after it leaves the nozzle. Because so much power is lost before it reaches the target object, the cavitating action on the surface of the target object is undesirably low.

High-pressure non-cavitating jets can be used in the applications mentioned above (fragmenting, surface cleaning, etc.); it is known, however, that a cavitating jet can achieve the same erosive effect as a non-cavitating jet using considerably less pressure and hydraulic power. Therefore, employing cavitating jets can not only reduce the costs but also enhance operational safety.

It is possible to generate a cavitating jet in air by artificially submerging a continuous waterjet (R. Houlston and G. W Vickers, Surface Cleaning Using Water-Jet Cavitation and Droplet Erosion. Proc. 4$^{th}$ Int. Symp. on Jet Cutting Technology, 1978, paper H1, pp. H1-1/H1-18). However, this system is relatively complex as it necessitates two separate sources of fluid.

Applicant published a study of a nozzle device for generating cavitating or pulsed water jets (M. M. Vijay, R. J. Puchala and N. Paquette, Study of a Novel Device for Generating Cavitating and Pulsed Water Jets. Proc, 13$^{th}$ International Conference on Jetting Technology, Sardinia, Italy, 29-31 Oct. 1996, BHR Group Limited). The elementary reverse-flow nozzle was also disclosed in a further publication (M. M. Vijay, C. Bai, W. Yan and A. Tieu, "Reverse flow nozzle generating natural cavitating or pulsed water-jets—Basic Study and Applications", Jetting Technology. pp. 243-252, BHR Group (2000). The reverse-flow nozzles disclosed in these publications utilized a continuous jet inlet and distinct lateral inlets for the reverse jet and the shroud jet. The nozzle design was thus complex as it required separate lateral inlets for the reverse jet and shroud jet. A simpler, more efficient, more practical and more cost-effective reverse-flow nozzle thus remained highly desirable. A solution to this technical problem is disclosed herein.

SUMMARY

The embodiments of the present invention provide an innovative nozzle and method for generating cavitating or pulsed jets of liquid, for example water, wherein the jets can be produced in an open atmosphere, without the need for submersion.

The embodiments of the present invention also provide an innovative nozzle and method for generating cavitating jets of liquid wherein the jets retain, when reaching the target, a significant fraction of the cavitating bubbles initially present when discharged from the nozzle.

Accordingly, one aspect of the present invention is a nozzle for generating a cavitating jet of pressurized liquid by generating cavitating vapor bubbles in a pressurized stream of the liquid supplied to the nozzle from a source of the pressurized liquid. This nozzle for generating a cavitating jet of pressurized liquid includes a main channel extending through the body of the nozzle. The main channel has a main inlet for receiving the pressurized liquid and a main outlet for discharging the pressurized liquid from the nozzle. The main channel includes a mixing chamber disposed between the inlet and the outlet. The nozzle also includes a flow-reversing channel having a first liquid-diverting inlet for diverting a portion of the pressurized liquid from a main stream flowing through the main channel. The flow-reversing channel includes a reverse-flow outlet connected to the mixing chamber for discharging a reverse flow of pressurized liquid into the mixing chamber. The reverse flow creates shear forces between the main stream and the reverse flow which generate cavitating bubbles in the main stream of pressurized liquid in the mixing chamber. This generates the cavitating jet. The nozzle further includes a shroud-generating channel having a second liquid-diverting inlet for receiving pressurized liquid from the mixing chamber and a shroud-jet outlet disposed radially outwardly of the main outlet of the main channel. The shroud-jet outlet discharges an annular shroud jet that enshrouds the cavitating jet discharging from the main outlet.

Another aspect of the present invention is a nozzle for generating a naturally pulsed jet of pressurized liquid. The nozzle has a body comprising a main channel extending through the body. The main channel has an inlet for receiving the pressurized liquid and an outlet for discharging the pressurized liquid from the nozzle. The main channel includes a mixing chamber disposed between the inlet and the outlet. The nozzle also includes a flow-reversing channel having a first liquid-diverting inlet for diverting a portion of the pressurized liquid from a main stream flowing through the main channel and a reverse-flow outlet connected to the mixing chamber for discharging an angled reverse flow of pressurized liquid into the mixing chamber at an angle relative to the main stream to thereby intermittently interrupt the main stream, thereby generating the naturally pulsed jet. The nozzle further includes a shroud-generating channel having a second liquid-diverting inlet for receiving pressurized liquid from the mixing chamber and a shroud-jet outlet disposed radially outwardly of the main outlet of the main channel, the shroud jet outlet discharging an annular shroud jet that enshrouds the pulsed jet discharged from the main outlet.

Yet another aspect of the present invention is a reverse-flow cavitation nozzle for generating a cavitating jet of pressurized liquid. The nozzle includes a nozzle body having a main inlet for receiving a stream of the pressurized liquid, a main channel extending through the nozzle body from the main inlet to a main outlet, and a flow-reversing channel in fluid communication with the main channel at a point upstream of a mixing chamber. This channel diverts into the flow-reversing channel a diverted portion of the liquid from the main channel and returns the diverted liquid to the mixing chamber as a reverse-flow jet relative to a main stream of liquid flowing toward the outlet. The reverse-flow jet interacts with the main stream to generate the cavitating jet that discharges from the main outlet.

Yet another aspect of the present invention is a reverse-flow nozzle for generating a naturally pulsed jet of pressurized liquid. The nozzle includes a nozzle body having a main inlet for receiving a stream of the pressurized liquid, a main channel extending through the nozzle body from the main inlet to a main outlet, and a flow-reversing channel in fluid communication with the main channel at a point upstream of a mixing chamber for diverting into the flow-reversing channel a diverted portion of the liquid from the main channel and for returning the diverted liquid to the mixing chamber as a reverse-flow jet that is both reversed and angled relative to a main stream of liquid flowing toward the outlet. The reverse-flow jet intermittently interrupts the main stream to generate the naturally pulsed jet that discharges from the main outlet.

BRIEF DESCRIPTION OF THE DRAWINGS

Further features and advantages of the present invention will become apparent from the following detailed description, taken in combination with the appended drawings, in which.

DETAILED DESCRIPTION

Figure 1:
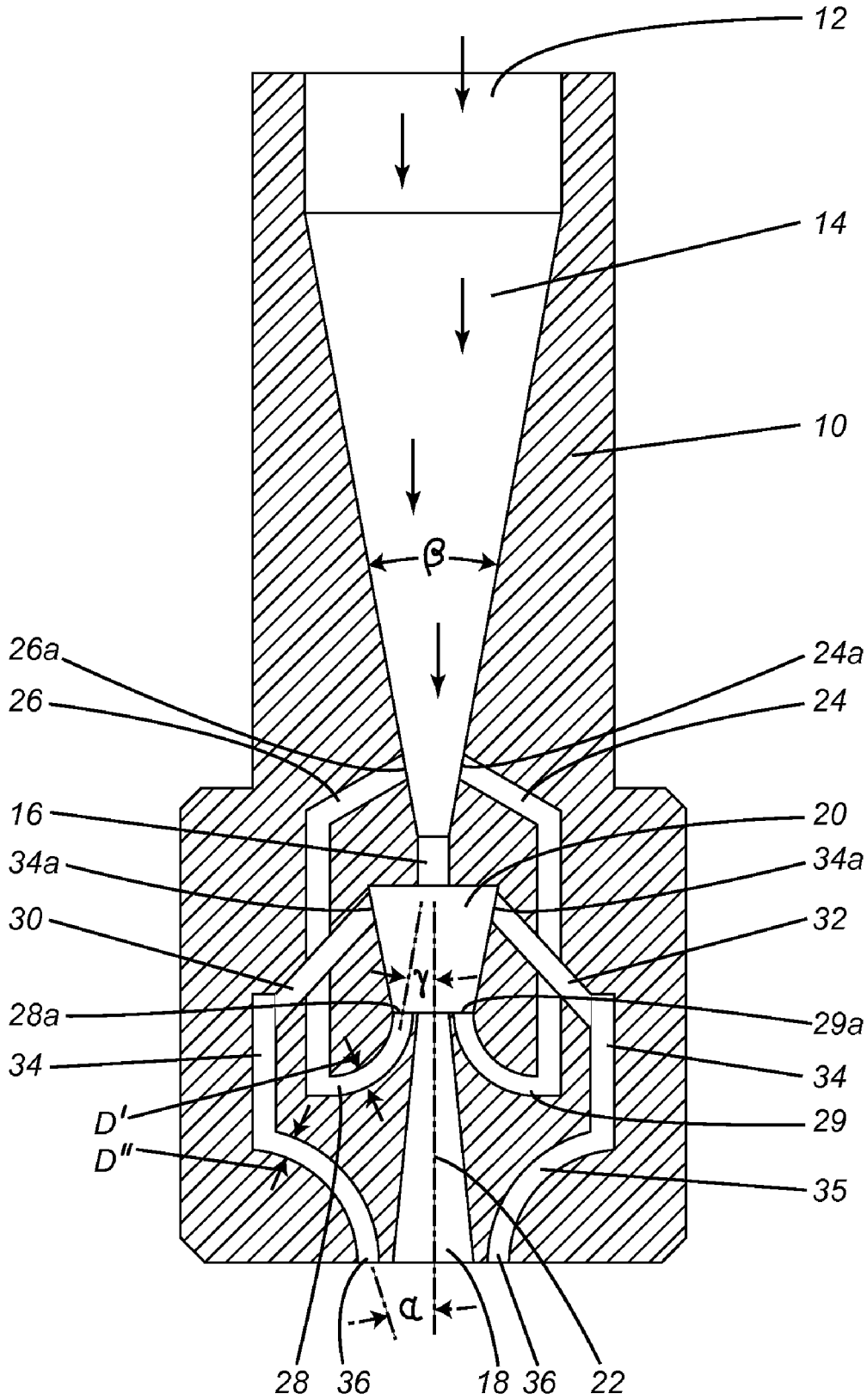
FIG. 1 is a cross-sectional view of a nozzle in accordance with an embodiment of the present invention.

In general, the nozzles disclosed herein create an internal reverse flow to generate a cavitating jet, a naturally pulsed jet or a combination of the two by virtue of the interaction between the main jet (main stream) and the reverse-flow jet (e.g. by virtue of shear forces at the interface). The nozzles may generate a cavitating or pulsed jet with or without a surrounding or annular shroud jet.

In embodiments of the present invention, the nozzle has a body (or nozzle body) comprising a main channel (which may be a central fluid flow channel) extending from a main inlet of the nozzle body to a main outlet of the nozzle body. The main inlet is disposed at an upstream end of the body for receiving a main stream (or main jet) of the pressurized liquid. In other words, pressurized liquid flows into the nozzle through the main inlet. The main outlet is disposed at a downstream end of the body for discharging the cavitating and/or pulsed jet of the pressurized fluid from the nozzle. In other words, the cavitating jet or pulsed jet discharges or exits from the nozzle through the main outlet. The main channel may be formed substantially centrally or axially through the body of the nozzle (i.e. the main channel may be a fluid passage that extends along a longitudinal central axis of the body). The main channel (central flow channel) includes or defines a mixing chamber disposed intermediate the main inlet and the main outlet. Interaction between the main jet and reverse-flow jet in the mixing chamber is what generates the cavitating and/or naturally pulsed jet.

A first channel (i.e. a flow-reversing channel) is formed in the nozzle body. This flow-reversing channel has an inlet (i.e. a liquid-diverting inlet) for diverting a portion of the pressurized liquid from the main stream or main jet. The diverted liquid flows through a loop-shaped channel that reverses its direction of flow. An outlet of this channel (i.e. a reverse-flow outlet) is connected (directly or indirectly) to the mixing chamber for discharging the diverted liquid back into the mixing chamber. The diverted liquid is discharged back into the mixing chamber in a direction reverse to the main stream, i.e. generally oppositely (counter-currently) to a direction of flow of the main stream of liquid. The reverse-flow jet provided by the flow-reversing channel creates shear forces and resulting cavitation bubbles in the liquid in the mixing chamber.

An optional second channel (shroud-generating channel) may be provided in the nozzle body. This second (shroud-generating) channel has a second (liquid-diverting) inlet for receiving pressurized liquid from the mixing chamber. The second channel also has a shroud jet outlet disposed radially outwardly of the main outlet of the main channel. The shroud jet outlet discharges an annular shroud jet that enshrouds the cavitating jet discharged from the main outlet. The outlet may be disposed proximate the main outlet of the main channel and may be in a converging relationship to a longitudinal axis of the main channel in the direction of flow of the liquid through the main channel. The outlet is disposed such as to direct a stream of liquid towards, and generally co-currently with the direction of, the main stream of liquid discharged from the central channel. In other words, the shroud jet is discharged in the same direction as the cavitating or pulsed jet exiting the main outlet such that the shroud jet envelops or enshrouds the cavitating or pulsed jet.

The liquid-diverting inlet of the first (flow-reversing) channel may be connected to a portion of the main channel upstream of the mixing chamber. In one embodiment, the liquid-diverting inlet of the flow-reversing channel is connected (in fluid communication with) a converging section between the main inlet and the mixing chamber.

The second liquid-diverting inlet of the second (shroud-generating) channel may be connected to the mixing chamber in a manner to receive pressurized liquid from the mixing chamber and discharge this liquid from the nozzle as an annular shroud of liquid surrounding and protecting the cavitating jet.

In one embodiment, the outlet of the second channel is disposed peripherally or tangentially to the main outlet of the main channel such as to provide a circumfluent stream of liquid towards the cavitating or pulsed jet leaving the central channel in a manner to envelop or enshroud the central stream.

In one specific embodiment, the outlet portion of the second channel is annular and concentric with the axis of the main channel at the main outlet of the nozzle.

In one specific embodiment, the outlet of the first channel is disposed at an angle of about 3 degrees to about 10 degrees to the longitudinal axis of the main channel. This results in the annular stream from the first channel "gently" contacting the central stream of fluid in the mixing chamber without significantly impairing the kinetic energy of the central stream while creating shear forces and resulting cavitational vapor bubbles at the interface of the two streams.

Further, in one embodiment, the annular end portion (outlet) of the second channel is disposed at a small (highly oblique) angle to the axis of the main channel. The angle should be such as to enable the annular stream of fluid from the second annular channel to merge with, and envelop or enshroud, the central stream of fluid to protect the cavitational bubbles therein so that the bubbles remain within the jet until impact with the target. The shroud jet thus protects or retains the bubbles within the jet without significantly disturbing the main jet or impairing its kinetic energy.

The cross-sectional dimensions (e.g. diameter) of the mixing chamber are, in one embodiment, significantly greater than the diameter of the narrowest spot ("the throat") of the converging section of the central channel, for two reasons: first, to create, in operation, a partial vacuum in the mixing chamber (according to the Bernoulli Theorem), and secondly, to accommodate, in operation, an increased flow of fluid, caused by the additional stream from the first channel. In one embodiment, the diameter of the mixing chamber at its upstream end is greater than at its downstream end.

Although various types of liquid may be used with this nozzle, the most practical implementation would be for generating cavitating or pulsed water jets. In theory, cavitation can occur in any liquid. The dimensional number used to determine whether cavitation occurs or not is the "cavitation number," which is a function of local velocity and the dynamic pressure of the flow of liquid. Cavitation number, in turn, can depend on Reynolds number, etc. In the present application, the occurrence of cavitation depends on the intensity of turbulence between the main (central flow) and the reverse flow, because turbulence, by definition, consists of eddies, and the pressure at the center of eddies can be quite low. If this pressure is equivalent to the vapor pressure of the liquid at the local temperature, then the liquid can flash into vapor, forming cavitation bubbles.

The embodiments of the present invention will now be described in greater detail with regard to the specific implementations illustrated in the appended figures.

FIG. 1 depicts a cross-sectional view of a nozzle body, generally designated by reference numeral 10, with a main channel (defined by various sections 12, 14, 16, 20, 18, 22 to be described below) extending through the nozzle body. The main channel, which may have various different circular and varying cross-sections throughout its length, has a main inlet 12 and a main outlet 18 for, respectively, receiving a stream of pressurized liquid from a source of pressurized liquid (e.g. pump, not shown) and discharging the stream of pressurized liquid towards a target 38 (or surface, object, work-piece, etc) shown in FIG. 2. The direction of liquid flow through the main channel is indicated by arrows in FIG. 1 and FIG. 2.

The main channel may have a converging section 14 which converges (e.g. tapers linearly) in the direction of flow which extends into a cylindrical or tubular throat 16 (i.e. a tubular passageway of uniform circular cross-sectional area) which, in turn, extends into a mixing chamber 20, which may be a frustaconical mixing chamber 20. The angle of convergence, β, can be from about 10 degrees to 45 degrees and preferably about 13 degrees to 25 degrees. Downstream of the mixing chamber 20 is an outlet section 22 of the central channel which terminates with the main outlet 18. The outlet section 22 leading to the main outlet 18 may have a diverging shape, as illustrated by way of example in FIG. 1, with the angle of divergence being, for example, from about 10 degrees to about 25 degrees. In the embodiment illustrated, the diameter of the mixing chamber 20 is greater than the diameter of the main channel on each of its ends adjacent the mixing chamber 20.

Figure 2:
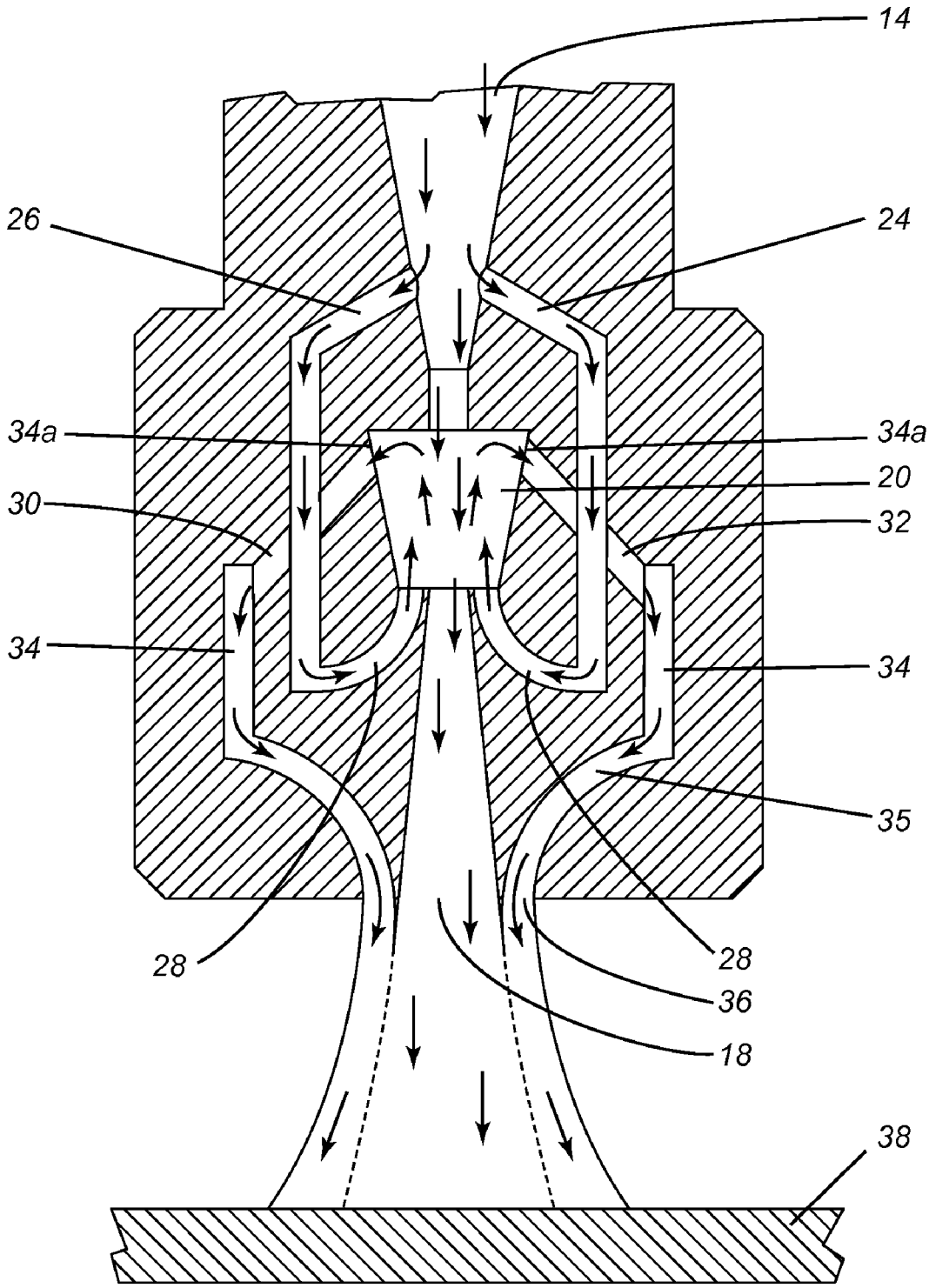
FIG. 2 is an enlarged cross-sectional view of the nozzle of FIG. 1, schematically depicting flow patterns inside the nozzle.

As illustrated by way of example in FIG. 1 and FIG. 2, the nozzle (or the nozzle body) includes a flow-reversing channel 24, 26, 28, 29 having first liquid-diverting inlets 24*a*, 26*a* for diverting a portion of the pressurized liquid from a main stream flowing through the main channel. The flow-reversing channels 24, 26, 28, 29 also include respective reverse-flow outlets 28*a*, 29*a* connected to the mixing chamber for discharging a reverse flow of pressurized liquid into the mixing chamber relative to the main stream to thereby generate the cavitating or naturally pulsed jet. The flow-reversing channels may include angled channel portions 24, 26 followed by parallel channel portions (parallel to a longitudinal axis of the main channel) and looped or curved channel portions 28, 29 that reverse the flow back into the mixing chamber.

In other words, in the illustrated embodiment, the nozzle includes two tubular channels 24, 26 that extend from the converging section 14, at a point near but upstream of the throat 16, into respective annular channels 28, 29 which reverse the flow and discharge the flow into the mixing chamber 20 at the downstream end of the mixing chamber 20. Curved or looped channel portions 28, 29 surround concentrically an upstream portion of the outlet section 22 of the main channel. The channel portions 28, 29 are disposed to direct a reverse-flow jet of liquid into the mixing chamber 20 at an angle γ which may be from about 3 to 7 degrees. While FIG. 1 shows the cross-sectional dimension, or width D', of each of the annular channel portions 28, 29 to be similar to the diameter of the inlet channel portions 24, 26, it will be understood that the former, in order to retain the linear velocity of the stream of fluid carried therethrough, should be much smaller than the latter since the curved channel portions 28, 29 carry the same flow as the two inlet channel portions 24, 26. The channels 24, 26, 28, 29 together form the flow-reversing channel(s).

The main channel provides a straight (linear) path of liquid flow through the converging section 14, the throat 16 and the mixing chamber 20, while channels 24, 26, 28 and 29 provide an alternative fluid flow route between the converging section 14 and the mixing chamber 20.

As further illustrated by way of example in FIG. 1 and FIG. 2, two shroud-generating channels (collectively designated by reference numerals 30, 32, 34, 35, 36) have second liquid-diverting inlets 34*a* that draw liquid from an upstream end of the mixing chamber 20 into angled inlet channel portions 30, 32 which deliver the liquid to substantially parallel annular channel portions 34 which in turn deliver the liquid into curved, converging channel portions 35. These curved, converging channel portions 35 terminate in shroud-jet outlets 36 for discharging an annular shroud jet. The shroud-generating channels are radially spaced from the flow-reversing channels.

The same flow is carried consecutively by the channel portions 30, 34, 35. For this reason, the actual dimension D" of the channel portion 35 is smaller than the diameter of the channel portions 30, 34. This relationship prevents a significant reduction of the velocity of fluid flow in the annular channel 35 compared to the velocity of flow in the channels 30, 34.

In one embodiment, the diameters, or widths, of all the channels described and illustrated herein are selected so that, in operation, the velocity of flow of liquid discharged towards the target surface 38 from the outlet 18 of the central channel is substantially equal to the velocity of the stream discharged from the outlet 36. This enables the two streams to merge relatively smoothly, without the central stream of liquid losing much energy, while the annular stream of liquid from outlet(s) 36 envelops (or enshrouds) the central stream (main jet) and protects the cavitating bubbles therein.

In the embodiment illustrated by way of example in FIG. 1 and FIG. 2, the annular channel portion 35 has an outlet 36 substantially adjacent or very near (i.e. in very close proximity to) the main outlet 18 of the central (main) channel. As shown by way of example, the channel portion 35 may taper in a curved and converging manner towards the main outlet 18. In the embodiment illustrated herein, the annular channel portion 35 at its outlet 36 surrounds concentrically the main outlet 18 of the central (main) channel and is spaced therefrom by a very small amount. In one embodiment, the outlet 36 of the annular channel portion 35 merges partly or entirely with the main outlet 18 of the central (main) channel, provided that the angle $\alpha$, defined by the directions of flow through the shroud-jet outlet 36 and the main outlet 18 is small, e.g. in the order of 5-10 degrees, such that the two streams, one from the central channel and the other annular stream from the channel 35, can merge smoothly without undue disturbance.

FIG. 2 illustrates the fluid flow within the exemplary nozzle of FIG. 1. As a pressurized stream of liquid (e.g. water) from a source (e.g. a pump) is passed through the converging section 14 of the main channel, the pressure in the converging section builds up. The main stream is diverted near the downstream end of the converging section 14 into a main axial, central stream (a main jet) and two (or more) shunted (bypass) streams which are forced by the pressure of water in the converging section 14 to pass through the flow-reversing channels. From the latter, an annular stream of liquid (e.g. water) is injected back into the mixing chamber 20 as a reverse-flow jet in a direction opposite to the direction of flow in the central channel. This reverse-flow jet may be substantially parallel or slightly angled relative to the longitudinal axis of the main jet flowing through the central channel and mixing chamber. As a result, the two counter-current streams shear against each other as they merge thereby creating shear forces dependent on the pressure of liquid and the dimensions and configuration of the channel(s) and the mixing chamber. In the mixing chamber, the shear forces at the interface of the main jet and the reverse-flow jet create cavitation in the liquid. The cavitating liquid contains vapor bubbles, the bubbles being immediately carried by the central stream of liquid towards the main outlet of the main channel. It will be appreciated that the sharp expansion of the main stream, which is created by a stepwise enlargement of the diameter of the central channel where it extends into the mixing chamber, has the effect of sucking the counter-current flow of water from the reverse-flow channel into the mixing chamber.

The excess pressure and volume of liquid in the mixing chamber caused by the annular stream from the reverse-flow channel result in some fluid from the mixing chamber being forced through the channels 30, 32 which are connected to the mixing chamber at its upstream end, and through the collecting channel 34 and the curved annular channel 35 to its outlet 36 located near the main outlet 18 of the central main channel. The converging shape of the channel portion 35 combined with a small angle $\alpha$ between the shroud jet and main jet causes the annular stream discharged from the shroud-jet outlet(s) 36 to create a sheath, envelope or shroud of fluid around the central stream of fluid discharged from the main outlet 18. The shroud jet protects the cavitation bubbles in the main cavitating jet in a manner similar to that of the surrounding liquid in a submerged jet. The protection is effective for a substantial stand-off distance, enabling the cavitating nozzle to be used in open air (i.e. without being submerged as required by the prior-art designs).

All of the liquid for the main jet, reverse-flow jet and shroud jet enters the nozzle via the main inlet. As such, only a single supply line of pressurized liquid is connected to the nozzle. In other words, the reverse-flow jet and the shroud jet are generated by diverting liquid internally from the main stream and the mixing chamber. No external sources of liquid are required to supply the reverse-flow and shroud jets.

A nozzle in accordance with another embodiment of the present invention is illustrated in FIG. 3 to FIG. 6. The nozzle body 10 has a main channel (which may be a central or axial flow channel) which defines a main inlet 12, a converging section 14, a mixing chamber 20 and a main outlet 18. The nozzle may have a linearly diverging outlet section 22 leading from the mixing chamber 20 to the main outlet 18. The nozzle depicted in FIG. 3 to FIG. 6 includes only the flow-reversing channel(s) but not the shroud-generating channel(s) disclosed and depicted with reference to the nozzle of FIG. 1 and FIG. 2.

This nozzle may be used to generate a cavitating jet without a shroud jet. This nozzle (or "reverse-flow cavitation nozzle") includes a nozzle body 10 having a main inlet 12 for receiving a stream of the pressurized liquid. A main channel extends through the nozzle body 10 from the main inlet 12 to a main outlet 18. A flow-reversing channel 24, 26 in fluid communication with the main channel at a point upstream of a mixing chamber 20 diverts into the flow-reversing channel 24, 26 a diverted portion of the liquid from the main channel. This diverted liquid is returned to the mixing chamber as a reverse-flow jet relative to a main stream of liquid flowing toward the main outlet 18. The reverse-flow jet interacts with the main stream to generate the cavitating jet that discharges from the main outlet 18.

In one embodiment, the reverse-flow cavitation nozzle comprises a converging section 14 between the main inlet 12 and the mixing chamber 20. The liquid-diverting inlet(s) 24*a*, 26*a* of the flow-reversing channel(s) 24, 26 may be in fluid communication with the converging section 14. In the embodiment illustrated by way of example, the nozzle of FIG. 3 may include a throat 16 of uniform circular cross-sectional area downstream of the converging section 14, and a frustaconical mixing chamber 20 downstream of the throat 16.

Figure 3:
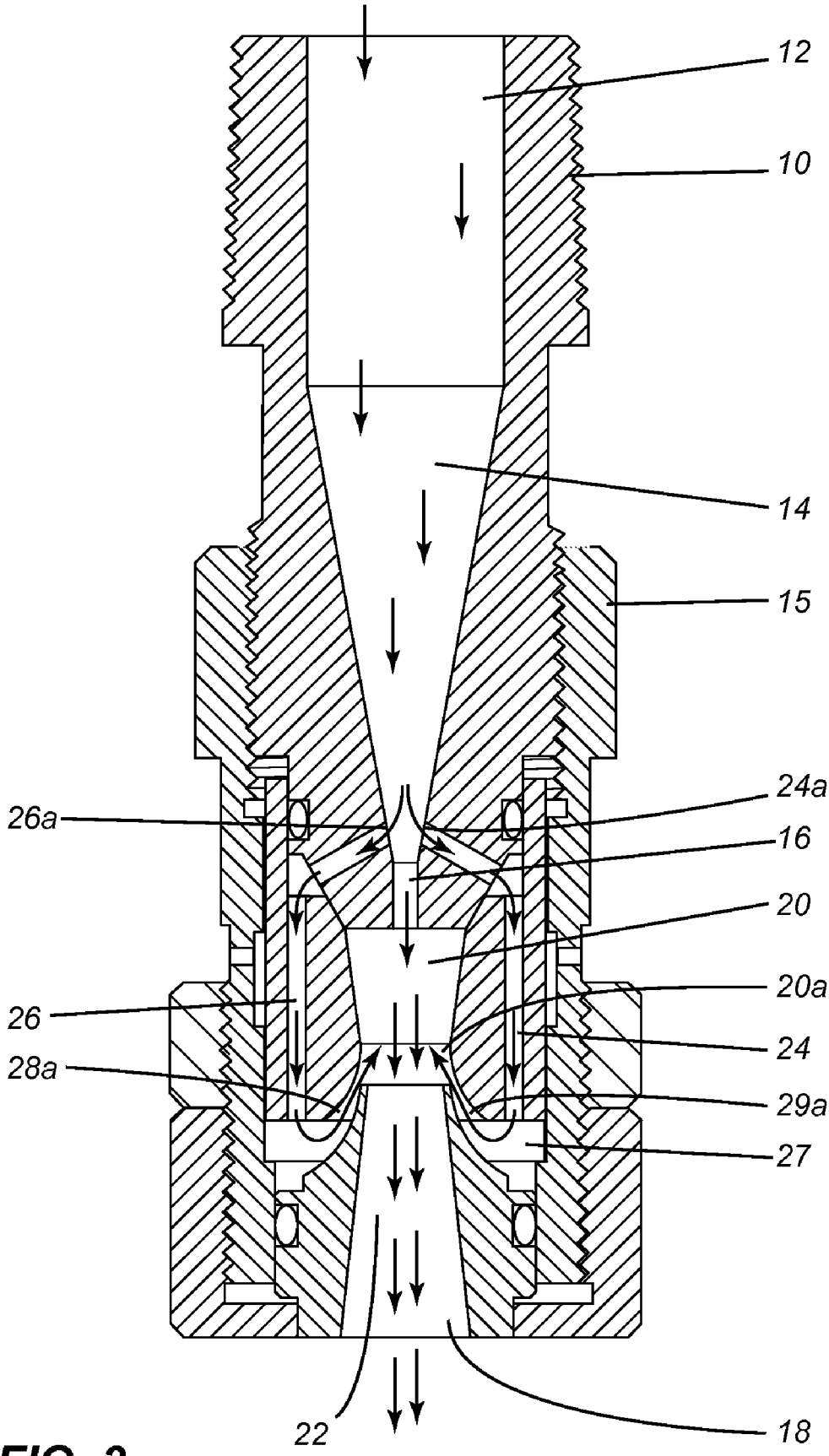
FIG. 3 is a cross-sectional view of another nozzle in accordance with another embodiment of the present invention.

The liquid-diverting inlet(s) 24*a*, 26*a* of the flow-reversing channel 24, 26 are in fluid communication with the converging section 14 while the reverse-flow outlet(s) 28*a*, 29*a* of the flow-reversing channel(s) 24, 26 are in fluid communication with a downstream end of the mixing chamber 20. In one specific embodiment, as shown in FIG. 3, the channels 24, 26 discharge into an annular space 27 concentric to an upstream portion of the outlet section 22. Liquid flows back from this annular space 27 into the mixing chamber 20 or into an intermediate chamber 20*a* disposed between the mixing chamber 20 and the outlet section 22. The intermediate chamber may have an outwardly curved (diverging) shape as shown by way of example in FIG. 3 and FIG. 4. As shown in FIG. 3, the top (upstream) end of the male insert 25 protrudes into the intermediate chamber. The intermediate chamber and mixing chamber may be formed within the female insert 19 as shown by way of example in FIG. 4.

The mixing chamber 20 may have a frustaconical shape disposed axially along a direction of fluid flow. In one embodiment, a diameter of the mixing chamber 20 at the upstream end of the mixing chamber is greater than a diameter of the mixing chamber at the downstream end of the mixing chamber.

A variant of the nozzle depicted in FIG. 3 may be used as a reverse-flow nozzle for generating a naturally pulsed jet of pressurized liquid. The variant (pulse-generating) nozzle uses a reverse-flow jet that is both reversed and angled relative to a main stream of liquid flowing toward the main outlet. The angled reverse-flow jet intermittently interrupts the main stream to generate the naturally pulsed jet.

Figure 4:
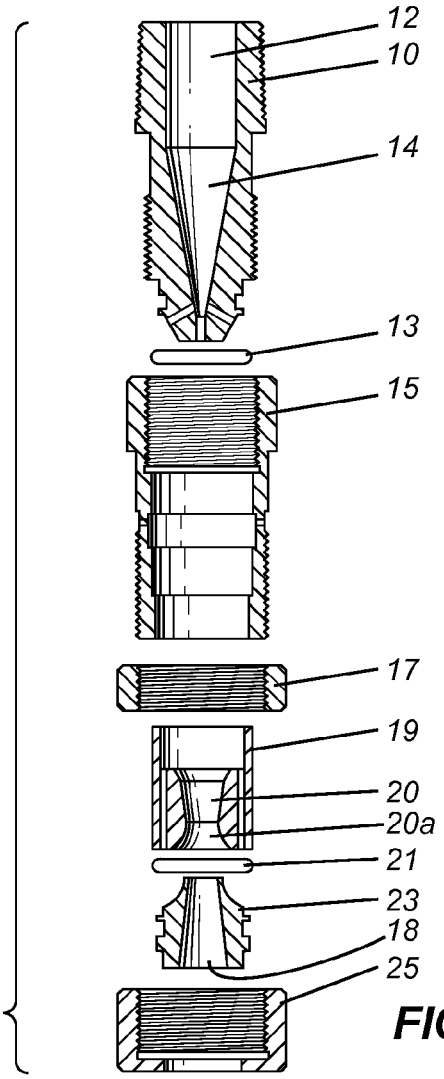
FIG. 4 is a cross-sectional assembly view of the nozzle of FIG. 3.
Figure 5:
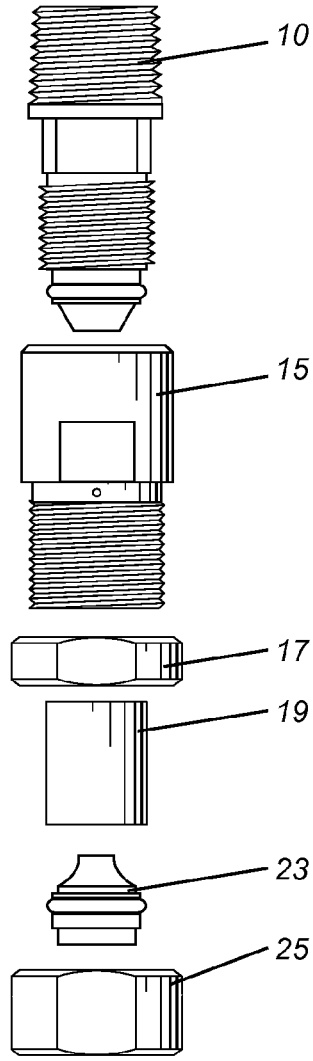
FIG. 5 is an assembly view of the nozzle of FIG. 3.
Figure 6:
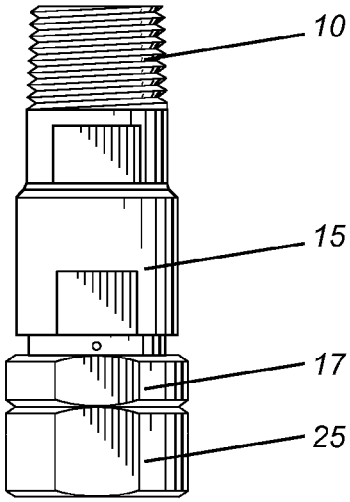
FIG. 6 is a view of the assembled nozzle of FIG. 3.

FIG. 4 to FIG. 6 show exemplary components that can be used to assemble the nozzle of FIG. 3 (in cross-section in FIG. 4, as an exploded (assembly) view in FIG. 5 and as an assembled view in FIG. 6). In the exemplary embodiment depicted in these figures, the nozzle includes an upper nozzle body (or inlet fixture) 10 having external threads, an O-ring, gasket or other sealing element 13, a housing 15 having internal and external threads, a jam nut 17, a female insert 19, an O-ring, gasket or other sealing element 21, a male insert 23 and a positioning nut 25. The components presented in FIG. 4 to FIG. 6 represent the best mode of manufacturing the nozzle (i.e. the most cost-effective way of machining the various parts). However, it should be appreciated that the nozzle of FIG. 3 to FIG. 6 may be manufactured in other ways with parts that are machined, cast or otherwise made of other forms or using other fabrication techniques.

All of the liquid for the main jet and reverse-flow jet enters the nozzle via the main inlet. As such, only a single supply line of pressurized liquid is connected to the nozzle. In other words, the reverse-flow jet is generated by diverting liquid internally from the main stream. No external source of liquid is required to supply the reverse-flow jet.

Like the nozzle depicted by way of example in FIG. 1 and FIG. 2, the nozzle depicted by way of example in FIG. 3 to FIG. 6 may generate a cavitating jet or a naturally pulsed jet or a jet that is both cavitating and pulsed (or that fluctuates between these two modes). A pulsed jet may form instead of a cavitating jet depending on how the reverse flow occurs through the narrow passages in the nozzle. It is believed that if the reverse flow is truly parallel to the main flow, cavitation is the dominant mechanism. Cavitation is believed to occur at the interface of the two mixing layers, i.e. at the interface of the central stream and the reverse-flow annular stream. However, if the reverse flow impinges (that is, flows) at a slight angle to the central jet, then the reverse flow may momentarily interrupt the main jet, causing the formation of an interrupted jet. The momentary interruptions in the main jet create a pulsed jet (referred to herein as a natural pulsed jet because it occurs basically due to the interaction between the two streams, without any external excitation, that is, not forced as is the case with forced pulsed waterjet (FPWJ) such as disclosed in U.S. Pat. No. 7,594,614 (Ultrasonic Waterjet Apparatus).

Frequently, it is extremely difficult to determine whether cavitation occurs or pulses occur (or an intermittent combination of both). However, an assumption can be made that cavitation dominates (using the nozzles disclosed herein) because of the signature bell-shaped erosion curve as a function of standoff distance. In the cavitation literature, this bell-shaped erosion curve is usually associated with cavitation.

Accordingly, the nozzles disclosed herein can thus be used (or adapted or modified for use) to generate not only a cavitating jet but also a (natural) pulsed jet. In some cases, depending on the fluid dynamics, the jet may be purely cavitating while in other cases the jet may be purely pulsed. In still other cases, the jet may be a hybrid, i.e. simultaneously both cavitating and pulsed.

Each of the nozzles described above and depicted in the accompanying figures is a single device that generates, using a single source of pressurized liquid, a cavitating or naturally pulsed stream that may be optionally surrounded by a protective envelope or shroud in the form of a shroud jet. This cavitating or pulsed jet can thus be projected through air (i.e. it need not be submerged). This cavitating or pulsed jet may be used to cut, fracture, or abrade materials. For example, the nozzle may be used for cavitation shotless peening (CSP), i.e. waterjet peening that does not require shot. This technology may be used for a wide variety of applications, including surface preparation, coating removal, cutting materials, fracturing matter like rocks, etc.

The embodiments of the invention described above are intended to be exemplary only. As will be appreciated by those of ordinary skill in the art, to whom this specification is addressed, many obvious variations can be made to the embodiments present herein without departing from the spirit and scope of the invention. The scope of the exclusive right sought by the applicant is therefore intended to be limited solely by the appended claims.

The invention claimed is:

1. A nozzle for generating a cavitating jet of pressurized liquid, the nozzle having a body comprising:

a main channel extending through the body, the main channel having a main inlet for receiving the pressurized liquid and a main outlet for discharging the pressurized liquid from the nozzle, the main channel including a mixing chamber disposed between the inlet and the outlet;

a flow-reversing channel having:

a first liquid-diverting inlet for diverting a portion of the pressurized liquid from a main stream flowing through the main channel; and a reverse-flow outlet connected to the mixing chamber for discharging a reverse flow of pressurized liquid into the mixing chamber to thereby create shear forces between the main stream and the reverse flow that generate cavitating bubbles in the main stream of pressurized liquid in the mixing chamber, thereby generating the cavitating jet; and a shroud-generating channel having a second liquid-diverting inlet for receiving pressurized liquid from the mixing chamber and a shroud-jet outlet disposed radially outwardly of the main outlet of the main channel, the shroud jet outlet discharging an annular shroud jet that enshrouds the cavitating jet discharged from the main outlet.

2. The nozzle as claimed in claim 1 wherein the main channel comprises a converging section between the main inlet and the mixing chamber.

3. The nozzle as claimed in claim 2 wherein the inlet of the flow reversing channel is open to the converging section.

4. The nozzle as claimed in claim 1 wherein the mixing chamber defines an upstream end and a downstream end, the reverse-flow outlet of the flow reversing channel being open to the mixing chamber at the downstream end of the mixing chamber.

5. The nozzle as claimed in claim 4 wherein the second liquid-diverting inlet is connected to the upstream end of the mixing chamber.

6. The nozzle as claimed in claim 1 wherein the outlet of the shroud-generating channel is annular and concentric to a central longitudinal axis of the main channel at the main outlet.

7. The nozzle as claimed in claim 1 wherein the first liquid-diverting inlet of the flow-reversing channel is connected to the main channel upstream of the mixing chamber.

8. The nozzle as claimed in claim 1 wherein the transverse dimensions of the channels are selected such that a fluid velocity discharging from the main outlet is substantially equal to a fluid velocity exiting from the shroud-jet outlet.

9. The nozzle as claimed in claim 1 wherein the mixing chamber has a frustaconical shape disposed axially along a direction of fluid flow, wherein a diameter of the mixing chamber at the upstream end of the mixing chamber is greater than a diameter of the mixing chamber at the downstream end of the mixing chamber.

10. A nozzle for generating a naturally pulsed jet of pressurized liquid, the nozzle having a body comprising:

a main channel extending through the body, the main channel having a main inlet for receiving the pressurized liquid and a main outlet for discharging the pressurized liquid from the nozzle, the main channel including a mixing chamber disposed between the main inlet and the main outlet;

a flow-reversing channel having:

a first liquid-diverting inlet for diverting a portion of the pressurized liquid from a main stream flowing through the main channel; and a reverse-flow outlet connected to the mixing chamber for discharging an angled reverse flow of pressurized liquid into the mixing chamber at an angle relative to the main stream to thereby intermittently interrupt the main stream, thereby generating the naturally pulsed jet; and a shroud-generating channel having a second liquid-diverting inlet for receiving pressurized liquid from the mixing chamber and a shroud-jet outlet disposed radially outwardly of the main outlet of the main channel, the shroud jet outlet discharging an annular shroud jet that enshrouds the pulsed jet discharged from the main outlet.

11. The nozzle as claimed in claim 10 wherein the main channel comprises a converging section between the main inlet and the mixing chamber.

12. The nozzle as claimed in claim 11 wherein the inlet of the flow reversing channel is open to the converging section.

13. The nozzle as claimed in claim 10 wherein the mixing chamber defines an upstream end and a downstream end, the reverse-flow outlet of the flow reversing channel being open to the mixing chamber at the downstream end of the mixing chamber.

14. The nozzle as claimed in claim 13 wherein the second liquid-diverting inlet is connected to the upstream end of the mixing chamber.

15. The nozzle as claimed in claim 10 wherein the outlet of the shroud-generating channel is annular and concentric to a central longitudinal axis of the main channel at the main outlet.

16. The nozzle as claimed in claim 10 wherein the first liquid-diverting inlet of the flow-reversing channel is connected to the main channel upstream of the mixing chamber.

17. The nozzle as claimed in claim 10 wherein the transverse dimensions of the channels are selected such that a fluid velocity discharging from the main outlet is substantially equal to a fluid velocity exiting from the shroud-jet outlet.

18. The nozzle as claimed in claim 10 wherein the mixing chamber has a frustaconical shape disposed axially along a direction of fluid flow, wherein a diameter of the mixing chamber at the upstream end of the mixing chamber is greater than a diameter of the mixing chamber at the downstream end of the mixing chamber.

19. A reverse-flow cavitation nozzle for generating a cavitating jet of pressurized liquid, the nozzle comprising:

a nozzle body having a main inlet for receiving a stream of the pressurized liquid;

a main channel extending through the nozzle body from the main inlet to a main outlet;

a flow-reversing channel having a liquid-diverting inlet in fluid communication with the main channel at a point upstream of a mixing chamber for diverting into the flow-reversing channel a diverted portion of the liquid from the main channel and for returning the diverted liquid to the mixing chamber as a reverse-flow jet relative to a main stream of liquid flowing toward the main outlet, wherein the reverse-flow jet interacts with the main stream to generate the cavitating jet that discharges from the main outlet.

20. The reverse-flow cavitation nozzle as claimed in claim 19 further comprising a converging section between the main inlet and the mixing chamber.

21. The reverse-flow cavitation nozzle as claimed in claim 20 wherein the liquid-diverting inlet of the flow-reversing channel is in fluid communication with the converging section.

22. The reverse-flow cavitation nozzle as claimed in claim 19 further comprising a converging section between the main inlet and the mixing chamber, and a throat of uniform cross-sectional area downstream of the converging section, wherein the mixing chamber is a frustaconical mixing chamber located downstream of the throat.

23. The reverse-flow cavitation nozzle as claimed in claim 22 wherein the liquid-diverting inlet of the flow-reversing channel is in fluid communication with the converging section and wherein the flow-reversing channel further comprises a reverse-flow outlet in fluid communication with a downstream end of the mixing chamber.

24. The reverse-flow cavitation nozzle as claimed in claim 23 wherein the frustaconical shape of the mixing chamber is arranged axially along a direction of fluid flow, such that a diameter of the mixing chamber at the upstream end of the mixing chamber is greater than a diameter of the mixing chamber at the downstream end of the mixing chamber.

25. A reverse-flow nozzle for generating a naturally pulsed jet of pressurized liquid, the nozzle comprising:

a nozzle body having a main inlet for receiving a stream of the pressurized liquid;

a main channel extending through the nozzle body from the main inlet to a main outlet;

a flow-reversing channel having a liquid-diverting inlet in fluid communication with the main channel at a point upstream of a mixing chamber for diverting into the flow-reversing channel a diverted portion of the liquid from the main channel and for returning the diverted liquid to the mixing chamber as a reverse-flow jet that is both reversed and angled relative to a main stream of liquid flowing toward the main outlet, wherein the reverse-flow jet intermittently interrupts the main stream to generate the naturally pulsed jet that discharges from the main outlet.

26. The reverse-flow nozzle as claimed in claim 25 further comprising a converging section between the main inlet and the mixing chamber.

27. The reverse-flow nozzle as claimed in claim 26 wherein the liquid-diverting inlet of the flow-reversing channel is in fluid communication with the converging section.

28. The reverse-flow nozzle as claimed in claim 25 further comprising a converging section between the main inlet and the mixing chamber, and a throat of uniform cross-sectional area downstream of the converging section, wherein the mixing chamber is a frustaconical mixing chamber located downstream of the throat.

29. The reverse-flow nozzle as claimed in claim 28 wherein the liquid-diverting inlet of the flow-reversing channel is in fluid communication with the converging section and wherein the flow-reversing channel further comprises a reverse-flow outlet in fluid communication with a downstream end of the mixing chamber.

30. The reverse-flow nozzle as claimed in claim 29 wherein the frustaconical shape of the mixing chamber is arranged axially along a direction of fluid flow, such that a diameter of the mixing chamber at the upstream end of the mixing chamber is greater than a diameter of the mixing chamber at the downstream end of the mixing chamber.

* * * * *

UNITED STATES PATENT AND TRADEMARK OFFICE

CERTIFICATE OF CORRECTION

PATENT NO. : 8,297,540 B1
APPLICATION NO. : 13/206786
DATED : October 30, 2012
INVENTOR(S) : Mohan M. Vijay It is certified that error appears in the above-identified patent and that said Letters Patent is hereby corrected as shown below:

Column 1
Line 8, "jet." should be --jets.--
Line 14, "systems," should be --systems.--
Line 21, "micro jets" should be --micro-jets--
Line 56, "Jets." should be --Jets,--
Line 56, "Proc," should be --Proc.--
Line 62, "Technology." in the 1st instance should be --Technology,--

Column 4
Line 25, "shroud jet" should be --shroud-jet--
Line 26, "shroud" should be --shroud- --

Column 10
Line 40, Claim 1, "shroud" should be --shroud- --

Column 11
Line 28, Claim 10, "shroud" should be --shroud- --

Signed and Sealed this
Twenty-sixth Day of March, 2013

Teresa Stanek Rea
*Acting Director of the United States Patent and Trademark Office*